US005130222A

United States Patent [19]

Otsuka et al.

[11] Patent Number: 5,130,222

[45] Date of Patent: Jul. 14, 1992

[54] ELECTROPHOTOGRAPHIC PHOTORECEPTOR AND USE IN REPEATED COPYING

[75] Inventors: Shigenori Otsuka, Omiya; Mamoru Nozomi, Machida, both of Japan

[73] Assignee: Mitsubishi Kasei Corporation, Tokyo, Japan

[21] Appl. No.: 540,327

[22] Filed: Jun. 19, 1990

Related U.S. Application Data

[63] Continuation of Ser. No. 160,813, Feb. 26, 1988, abandoned, and a continuation-in-part of Ser. No. 921,225, Oct. 20, 1986, abandoned.

[30] Foreign Application Priority Data

Oct. 31, 1985 [JP] Japan ..... 60-244739

[51] Int. Cl.[5] ..... G03G 13/22

[52] U.S. Cl. ..... 430/126; 430/56; 430/59

[58] Field of Search ..... 430/84, 96, 83, 59, 430/126

[56] References Cited

U.S. PATENT DOCUMENTS 3,988,292 10/1976 Moriga et al. .
4,105,449 8/1978 Tanel et al. .
4,272,608 6/1981 Proskow ..... 430/288
4,935,327 6/1990 Takizawa et al. ..... 430/110

*Primary Examiner*—Roland Martin
*Attorney, Agent, or Firm*—David G. Conlin; Ernest V. Linek

[57] ABSTRACT

An electrophotographic photoreceptor having an electrically conductive substrate and a photosensitive layer formed thereon, the photosensitive layer comprising a charge-generating agent, an organic charge-transporting agent and an anti-oxidant having the general formula:

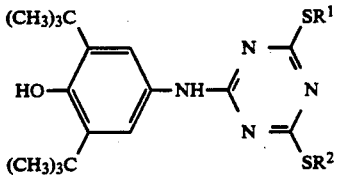

wherein $R^1$ and $R^2$ are independently alkyl groups, is disclosed herein. The electrophotographic photoreceptor according to this invention has an improved durability in repeated copying operations and therefore a prolonged life.

12 Claims, No Drawings

ELECTROPHOTOGRAPHIC PHOTORECEPTOR AND USE IN REPEATED COPYING

This is a continuation of co-pending application Ser. No. 07/160,813 filed on Feb. 26, 1988, now abandoned, and a continuation-in-part of U.S. Ser. No. 921,225, filed Oct. 20, 1986, now abandoned.

FIELD OF THE INVENTION

This invention relates to an electrophotographic photoreceptor. More specifically, it relates to a photoreceptor having improved durability in repeated copying operations which therefore exhibits prolonged life.

BACKGROUND OF THE INVENTION

An electrophotographic photoreceptor has an electrically conductive substrate and a photosensitive layer formed thereon which includes an inorganic or organic photoconductor.

Recently, double layer photoreceptors with a combination of a charge-generation layer and a charge-transport layer have been shown to have higher sensitivity and some of them have been commercially employed. Those photoreceptors in which an organic material is used as a charge-transporting medium and which have high charge acceptance in addition to their higher sensitivity have been highly studied.

An electrophotographic photoreceptor is subjected to repeated copying operations which include charging by corona charging device, exposing, developing, transferring and cleaning steps and is required to have excellent durability in such repeated copying operations. When the aforementioned photoreceptors, especially those photoreceptors having an organic charge-transporting medium are subjected to the repeated copying operation, however, a remarkable lowering of the charged potential is observed and the resultant copies have poor qualities.

The lowering of the charged potential is believed to be due to various causes. One of the causes is the effect of the gases on the corona charging step. Active gases such as ozone, nitrogen oxides and the like produced in the negative or a.c. corona discharging are particularly a problem. For resolving the effect of the gases, the ventillation of the gases near the corona discharger was attempted. However, this was not successful since the gases cannot be completely removed.

As another method for resolving the effect of these gases, the addition of an anti-oxidant to the photosensitive layer, specifically for protection of the charge-transporting medium, has been proposed. The use of trialkyl phenol derivatives and dilauryl thiopropionate are mentioned in Japanese Patent Publication Nos. 50-33857 and 51-34736 and Japanese Patent Application Laying Open Nos. 56-130759 and 57-122444. However, the addition of these types of anti-oxidant is not sufficiently effective.

Now, there is a strong need for an electrophotographic photoreceptor having improved durability in repeated copying operations without showing the remarkable lowering of the charged potential and therefore the prolonged life.

An object of this invention is to provide such an electrophotographic photoreceptor having improved durability in repeated copying operations and therefore prolonged life.

SUMMARY OF THE INVENTION

An electrophotographic photoreceptor according to this invention has an electrically conductive substrate and a photosensitive layer formed thereon, and the photosensitive layer comprises a charge-generating agent and an organic charge-transporting agent as a photoconductor and a specific anti-oxidant.

Detailed Explanation of the Invention

In the photoreceptor according to this invention, the photosensitive layer includes as the anti-oxidant, 2,4bis-alkylthio-6-(4-hydroxy-3,5-di-tert-butyl-anilino)-1,3,5-triazine having the following general formula:

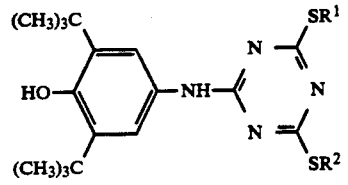

wherein $R^1$ and $R^2$ are independently alkyl groups, preferably 3 to 17 carbon atoms, for example, n-oxtyl.

The amount of the anti-oxidant in the photosensitive layer is 0.1 to 20%, preferably 1 to 10%, more preferably 2 to 10% by weight, based on the total weight of the photosensitive layer. In lesser amounts the lowering of the charged potential cannot be controlled satisfactorily, while in greater amounts undesirable phenomena such as high dark decay occur.

The charge-generating agent in the photosensitive layer may be an inorganic or organic photoconductor. The representative inorganic charge-generating agents include selenium or its alloys, cadmium sulfide and zinc oxide. The representative organic charge-generating agents include phthalocyanine, perillene, indigo, quinacridone and bis-azo compound and their derivatives.

A variety of the known organic charge-transporting agents can be employed in this invention. The representative organic charge-transporting agents include heterocyclic compounds such as indole, carbazole, imidazole, oxazole, thiazole, oxadiazole, pyrazole, pyrazoline, thiadiazole, benzoxazole, benzothiazole, benzimidazole and the like; aromatic hydrocarbons such as benzene, naphthalene, anthracene, fluorene, perillene, pyrene, phenylanthracene, styryl anthracene and the like; their substituted derivatives having any substituents such as alkyl, alkoxy, amino or substituted amino groups; the other derivatives such as triarylalkane, triarylamino, chalcone derivatives, hydrazine derivatives, hydrazones and the like; and their polymers such as polyvinyl carbazole, polystyryl anthracene and the like.

The photosensitive layer including the charge-generating agent, the organic charge-transporting agent and the anti-oxidant may be composed of a single layer or multiple layers.

The single photosensitive layer may be prepared by coating a dispersion of the charge-generating agent, the organic charge-transporting agent, the anti-oxidant and an optional polymeric binder in a suitable solvent.

The multiple photosensitive layers consist of at least one charge-generation layer which includes the photoconductor as the charge-generating agent and at least one charge-transport layer which includes the organic charge-transporting agent, the anti-oxidant and a polymeric binder. The charge-generation layer may be prepared by means of vapor-deposition or sputtering of the charge-generating agent. "Alternatively", the charge-generation layer can be prepared by coating a dispersion of the charge-generating agent optionally together with the polymeric binder in any suitable solvent. The latter method is preferable because the thickness of the layer can be suitably adjusted, the specific apparatus and/or method is unnecessary and the charge-generating agent is not subjected to the thermal decomposition by heating.

The preferable thickness of the charge-generation layer is about 0.1 to 1 micron. The charge-transport layer is also preferably prepared by coating the dispersion of the organic charge-transporting agent, the antioxidant together with the polymeric binder in any suitable solvent.

The charge-transporting agent is used in an amount of 20 to 150 parts, preferably 40 to 120 parts by weight per 100 parts by weight of the polymeric binder. The preferable thickness of the charge-transport layer is 10 to 30 microns. Though the charge-generation layer may be coated on the charge-transport layer, preferably the charge-transport layer is coated on the charge-generation layer because it protects the thinner charge-generation layer against wearing or contamination.

A variety of the known polymeric binders can be employed in this invention. The representative polymeric binders include homopolymer or copolymer of the vinyl compound such as styrene, vinyl chloride, acrylic or methacrylic esters and the like, phenoxy resin, polyvinyl acetal, polyvinyl butyral, polyester, polycarbonate, cellulose ester, silicone resin, urethane resin, unsaturated polyester and the like. Desirably, the polymeric binder compatible with the organic charge-transporting agent and, if necessary, the charge-generating agent is selected.

Furthermore, the photosensitive layer may include the conventional well-known additives, for example, a sensitizer, a plasticizer or an additive for preventing the accumulation of residual potential.

The photosensitive layer is formed on the electrically conductive substrate in accordance with any of the well-known methods. If necessary, the barrier layer which consists of polyamide, polyurethane or epoxy resin or aluminum oxide or the other intermediate layer may be provided between the photosensitive layer and the substrate.

A variety of the electrically conductive substrates can be employed in this invention. The representative substrates include metal foils, metal plates, laminated metal layers and vapor-deposited layers, the preferable metal being aluminum, copper or zinc. Alternatively, the conductive paper or plastics can be also employed as the substrate, which is prepared by coating an electroconductive material such as metal powder, carbon black, copper iodide, tin oxide or polymeric electrolytes thereto.

The electrophotographic photoreceptor according to this invention can be widely applied in the electrophotographic field, for example, in the copying machines, the printer having laser, CRT or LED as the optical source and the like.

EXAMPLES

The following examples will further describe various preferred embodiments of this invention and includes comparative examples.

All parts are by weight unless otherwise specified.

EXAMPLE 1A

One part of bis-azo compound having the following formula:

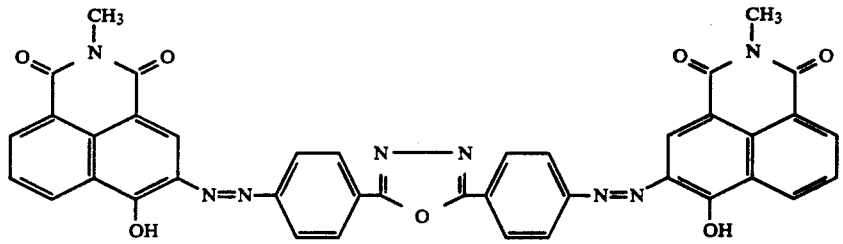

and 1 part of polyester (BAYRON® 200, manufactured by TOYOBO CO., LTD.) were dispersed in 90 parts of tetrahydrofuran with a sand grinder to prepare a coating dispersion. The thus-prepared dispersion was coated on an aluminum layer which had vapor-deposited on a polyester film with 100 microns thickness so that the dry thickness of the layer was 0.2 microns. Thus, the charge-generation layer was formed on the substrate.

While, 80 parts of N-methylcarbazole-3-aldehydediphenyl-hydrazone, 100 parts of methacrylic resin (DIANAL® BR-85, manufactured by Mitsubishi Rayon Co., Ltd.), 4.5 parts of dicyano compound having the following formula:

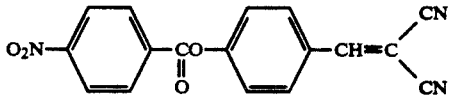

and 8 parts of 2,4-bis(n-octylthio)-6-(4-hydroxy-3,5-ditertbutylanilino)-1,3,5-triazine (OST) were dissolved in 900 parts of toluene to prepare a coating solution. The thus-prepared solution was coated on the above charge-generation layer so that the dry thickness of the charge-transport layer was 15 microns. Thus, the photoreceptor (sample No. 1A) according to this invention was prepared.

EXAMPLES 1B to 1F

For the comparison, the photoreceptors (sample Nos. 1B to 1F) were prepared in the same manner as described in Example 1A, provided that the amounts of OST were varied (1B=0 part; 1C=2 parts; 1D=4 parts; 1E=12 parts and 1F=16 parts).

EXAMPLE 1G

For the comparison, the photoreceptor (sample No. 1G) was prepared in the same manner as described in Example 1A, provided that 8 parts of OST was replaced with 8 parts of dilauryl thiopropionate.

EXAMPLE 2A and 2B

One part of bis-azo compound having the following formula:

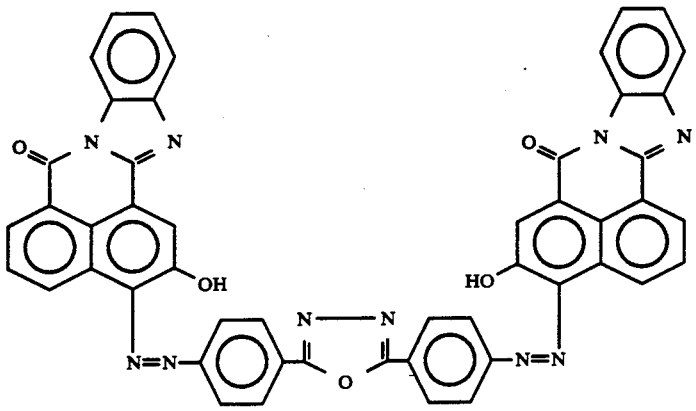

and 0.5 part of polyvinyl butyral (ESREC® BH-3, manufactured by Sekisui Chemical Co., Ltd.) were dispersed in 50 parts of 4-methoxy-4-methyl pentanone-2 with a sand grinder to prepare a coating dispersion. The thus-prepared dispersion was coated on an aluminum layer which had vapor-deposited on a polyester film with 100 microns thickness so that the dry thickness of the layer was 0.4 microns. Thus, the charge-generation layer was formed on the substrate.

While, 90 parts of hydrazone having the following formula:

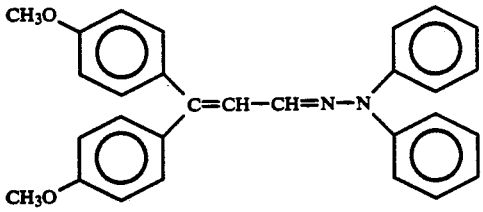

100 parts of polycarbonate resin (NOVAREX® 7030A, manufactured by MITSUBISHI CHEMICAL INDUSTRIES CO., LTD.) and 8 parts of OST were dissolved in 900 parts of dioxane to prepare a coating solution. The thus-prepared solution was coated on the above charge-generation layer so that the dry thickness of the charge-transport layer was 15 microns. Thus, the photoreceptor (sample No. 2A) according to this invention was prepared.

For the comparison, the photoreceptor (sample No. 2B) was prepared in the same manner as described in Example 2A, provided that the addition of OST was omitted.

EXAMPLES 3A and 3B

One part of bis-azo compound having the following formula:

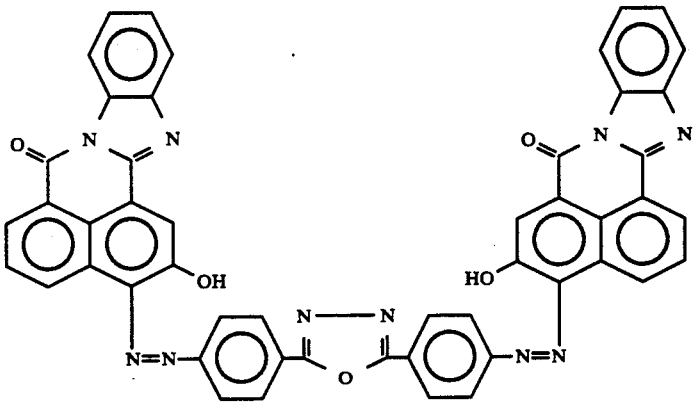

10 parts of hydrazone having the following formula:

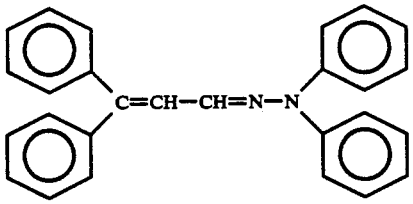

10 parts of methacrylic resin (DIANAL® BR-85, manufactured by Mitsubishi Rayon Co., Ltd.), 2 parts of polyvinyl butyral and 1 part of OST were dispersed in 90 parts of tetrahydrofuran with a sand grinder to prepare a coating dispersion. The thus-prepared dispersion was coated on an aluminum layer which had vapor-deposited on a polyester film with 100 microns thickness so that the dry thickness of the layer was 20 microns. Thus, the photoreceptor (sample No. 3A) according to this invention was prepared.

For the comparison, the photoreceptor (sample No. 3B) was prepared in the same manner as described in Example 3A, provided that the addition of OST was omitted.

EXAMPLE 3C

For the comparison, the photoreceptor (sample No. 3C) was prepared in the same manner as described in Example 3A, provided that 1 part of OST was replaced with 1 part of di-tert-butylhydroxytoluene.

EXAMPLE 4 i) Each of the photoreceptor prepared in the above Examples was charged by passing through corona charging device so as to determine the initial charged potential Vo. The passing speed was 150 mm/sec and the corona current was −22 μA.

Then, the photoreceptor was exposed to the white light as 5 lux until the surface potential was lowered to one-half of the initial charged potential. The exposure (E ½) was calculated from the taken time.

Then results are shown in Table 1.

ii) The photoreceptor was placed and exposed to ozone in the metal box in which the corona charging device was set to produce ozone in the manner that the corona ions produced during the corona discharge could not directly fall on the photoreceptor. High corona voltage at −6 kilovolts was applied to the corona charging device while circulating the air in the box by the fan. The ozone concentration in the box was 6 ppm.

After the photoreceptor was left under such an atmosphere for 14 hours, the charged potential (Vo) and the exposure (E ½) were measured.

The results are also in Table 1.

TABLE 1

| Sample No. | Anti-oxidant* content (%) | Intial characteristics Vo (V) | Intial characteristics E½ (lux sec) | Characteristics after ozone exposure Vo (V) | Characteristics after ozone exposure Vo lowering (%) | Characteristics after ozone exposure E½ (lux sec) |
|---|---|---|---|---|---|---|
| 1A | 4 | −560 | 2.7 | −540 | 3.5 | 2.7 |
| 1B | 0 | −550 | 2.7 | −384 | 30.2 | 2.2 |
| 1C | 1 | −545 | 2.6 | −466 | 14.5 | 2.4 |
| 1D | 2 | −550 | 2.8 | −517 | 6.0 | 2.8 |
| 1E | 6 | −564 | 2.9 | −541 | 4.0 | 2.8 |
| 1F | 8 | −553 | 2.7 | −543 | 1.8 | 2.7 |
| 1G | 4 | −540 | 2.5 | −380 | 29.6 | 2.2 |
| 2A | 4 | −560 | 1.8 | −530 | 5.4 | 1.7 |
| 2B | 0 | −565 | 1.8 | −440 | 22.1 | 1.5 |
| 3A | 4 | +780 | 1.7 | +720 | 7.7 | 1.5 |
| 3B | 0 | +760 | 1.7 | +600 | 21.1 | 1.3 |
| 3C | 4 | +760 | 1.7 | +650 | 14.5 | 1.4 |

*Weight percentage based on the total weight of the photosensitive layer

EXAMPLE 5

The durabilities of samples 1A and 1C in the repeated copying operation were tested using the commercial copying machine (SF 755, manufactured by Sharp Corporation).

In sample 1A, the clear print with high contrast was obtained even after the copying operations were repeated 40,000 times and the lowering of the charged potential was small (Vo lowering=7.4%). While, in sample 1C, after the copying operations were repeated 20,000 times the print became to be unclear and the lowering of the charged potential was remarkable (Vo lowering=27.3%).

As seen from the above results, the addition of the anti-oxidant clearly improves the durability of the photoreceptor in the repeated copying operations.

Effect of the Invention

The electrophotographic photoreceptor according to this invention is stable with respect to the charged potential in the repeated copying operations.

The electrophotographic photoreceptor according to this invention has the improved durability in the repeated copying operations and therefore the prolonged life.

What is claimed is:

1. In an electrophotographic method comprising repeated copying operations which include the steps of charging by a corona charging device, exposing, developing, transferring and cleaning, and which uses repeatedly a laminated electrophotographic photoreceptor having an electrically conductive substrate and a photosensitive layer formed thereon;

the improvement comprising:

preventing ozone deterioration of the organic charge-transporting agent contained in the laminated photoreceptor by providing a laminated photosensitive layer which consists essentially of at least one charge-generating layer which includes the photoconductor as the charge-generating agent, and at least one charge transport layer, which includes an organic charge-transporting agent, a polymeric binder, and 0.1 to 20 weight percent, based on the total weight of the photosensitive layer, of an anti-oxidant agent having the formula:

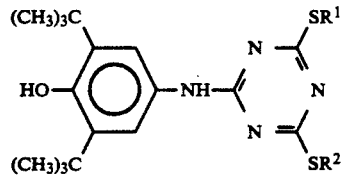

wherein $R^1$ and $R^2$ are independently alkyl groups of from 3 to 17 carbon atoms.

2. The method according to claim 1, wherein $R^1$ and $R^2$ are independently alkyl groups having 3 to 17 carbon atoms.

3. The method according to claim 2, wherein the alkyl group is n-octyl.

4. The method according to any one of claim 1 to 3, wherein the amount of the anti-oxidant is 0.1 to 20% by weight based on the total amount of the photosensitive layer.

5. The method according to claim 4, wherein the amount of the anti-oxidant is 1 to 10% by weight based on the total amount of the photosensitive layer.

6. The method according to claim 5, wherein the amount of the anti-oxidant is 2 to 10% by weight based on the total amount of the photosensitive layer.

7. The method according to claim 1, wherein the charge-generating agent is an inorganic agent.

8. The method according to claim 7, wherein the inorganic charge-generating agent is selenium or its alloy, cadmium sulfide or zinc oxide.

9. The method according to claim 1, wherein the charge-generating agent is an organic agent.

10. The method according to claim 9, wherein the organic charge-generating agent is phthalocyanine, perillene, indigo, quinacridone or bis-azo compound or their derivatives.

11. The method according to claim 1, wherein the organic charge-transporting agent is selected from heterocyclic compound, aromatic hydrocarbon and derivtives or polymers thereof.

12. The method according to claim 1, wherein a barrier layer is provided between the photosensitive layer and the substrate.

* * * * *